US006470601B1

(12) United States Patent
Zane

(10) Patent No.: US 6,470,601 B1
(45) Date of Patent: Oct. 29, 2002

(54) WATCH-CONTAINING SHOE

(76) Inventor: Robert W. Zane, 8 Starboard Ave., Barnegat, NJ (US) 08005

( * ) Notice: Subject to any disclaimer, the term of this patent is extended or adjusted under 35 U.S.C. 154(b) by 0 days.

(21) Appl. No.: 09/779,998

(22) Filed: Feb. 9, 2001

(51) Int. Cl.[7] ..... A43B 3/00
(52) U.S. Cl. ..... 36/132; 36/136; 36/54
(58) Field of Search ..... 36/132, 136, 54, 36/50.1; D2/896, 897, 946, 975, 976

(56) References Cited

U.S. PATENT DOCUMENTS 716,528 A * 12/1902 Flowers ..... 24/713.6
2,109,751 A * 3/1938 Matthias et al. ..... 36/178
4,053,995 A * 10/1977 Shein ..... 36/30 R
4,254,566 A 3/1981 Haskell
4,597,198 A 7/1986 Schweitzer
4,876,500 A * 10/1989 Wu ..... 36/132
D339,989 S 10/1993 Parsons
D341,924 S * 12/1993 Clement
5,402,589 A * 4/1995 Lubrani et al. ..... 24/712.2
5,452,269 A * 9/1995 Cherdak ..... 36/132
5,632,709 A 5/1997 Walsh
D380,970 S 7/1997 Phillips et al.
5,775,011 A 7/1998 Reitano, Jr.

* cited by examiner

*Primary Examiner*—M. D. Patterson

(57) ABSTRACT

A watch-containing shoe for allowing the user to know the time without having to carry or wear a watch. The watch-containing shoe includes a shoe having a top portion and side portions and including a tongue member having a top, a first end and a second end which is securely attached to the top portion; and also includes a watch being securely attached to the shoe.

1 Claim, 1 Drawing Sheet

WATCH-CONTAINING SHOE

BACKGROUND OF THE INVENTION

1. Field of the Invention

The present invention relates to a shoe with a watch and more particularly pertains to a new watch-containing shoe for allowing the user to know the time without having to carry or wear a watch.

2. Description of the Prior Art

The use of a shoe with a watch is known in the prior art. More specifically, a shoe with a watch heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. Nos. 5,775,011; Des. 339,989; Des. 380,970; 5,632,709; 4,254,566; and 4,597,198.

While these devices fulfill their respective, particular objectives and requirements, the aforementioned patents do not disclose a new watch-containing shoe. The inventive device includes a shoe having a top portion and side portions and including a tongue member having a top, a first end and a second end which is securely attached to the top portion; and also includes a watch being securely attached to the shoe.

In these respects, the watch-containing shoe according to the present invention substantially departs from the conventional concepts and designs of the prior art, and in so doing provides an apparatus primarily developed for the purpose of allowing the user to know the time without having to carry or wear a watch.

SUMMARY OF THE INVENTION

In view of the foregoing disadvantages inherent in the known types of shoe with a watch now present in the prior art, the present invention provides a new watch-containing shoe construction wherein the same can be utilized for allowing the user to know the time without having to carry or wear a watch.

The general purpose of the present invention, which will be described subsequently in greater detail, is to provide a new watch-containing shoe which has many of the advantages of the shoe with a watch mentioned heretofore and many novel features that result in a new watch-containing shoe which is not anticipated, rendered obvious, suggested, or even implied by any of the prior art shoe with a watch, either alone or in any combination thereof.

To attain this, the present invention generally comprises a shoe having a top portion and side portions and including a tongue member having a top, a first end and a second end which is securely attached to the top portion; and also includes a watch being securely attached to the shoe.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new watch-containing shoe which has many of the advantages of the shoe with a watch mentioned heretofore and many novel features that result in a new watch-containing shoe which is not anticipated, rendered obvious, suggested, or even implied by any of the prior art shoe with a watch, either alone or in any combination thereof.

It is another object of the present invention to provide a new watch-containing shoe which may be easily and efficiently manufactured and marketed.

It is a further object of the present invention to provide a new watch-containing shoe which is of a durable and reliable construction.

An even further object of the present invention is to provide a new watch-containing shoe which is susceptible of a low cost of manufacture with regard to both materials and labor, and which accordingly is then susceptible of low prices of sale to the consuming public, thereby making such watch-containing shoe economically available to the buying public.

Still yet another object of the present invention is to provide a new watch-containing shoe which provides in the apparatuses and methods of the prior art some of the advantages thereof, while simultaneously overcoming some of the disadvantages normally associated therewith.

Still another object of the present invention is to provide a new watch-containing shoe for allowing the user to know the time without having to carry or wear a watch.

Yet another object of the present invention is to provide a new watch-containing shoe which includes a shoe having a top portion and side portions and including a tongue member having a top, a first end and a second end which is securely attached to the top portion; and also includes a watch being securely attached to the shoe.

Still yet another object of the present invention is to provide a new watch-containing shoe that allows the user to have a watch without having to wear a watch around one's wrist.

Even still another object of the present invention is to provide a new watch-containing shoe that makes it easy and convenient for the user to read the time while standing up and while wearing one's shoe.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
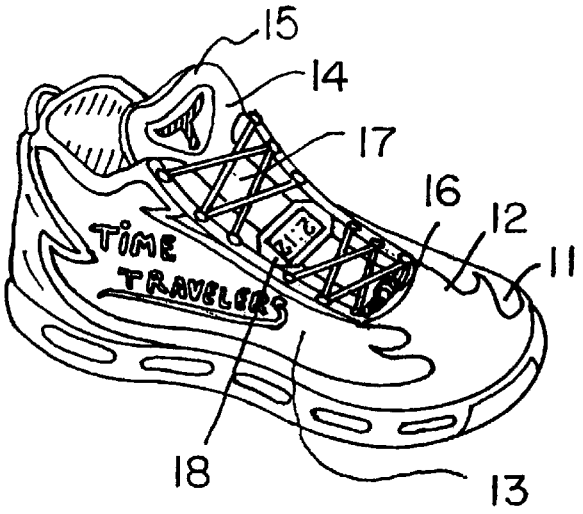
FIG. 1 is a perspective view of a new watch-containing shoe according to the present invention.
Figure 2:
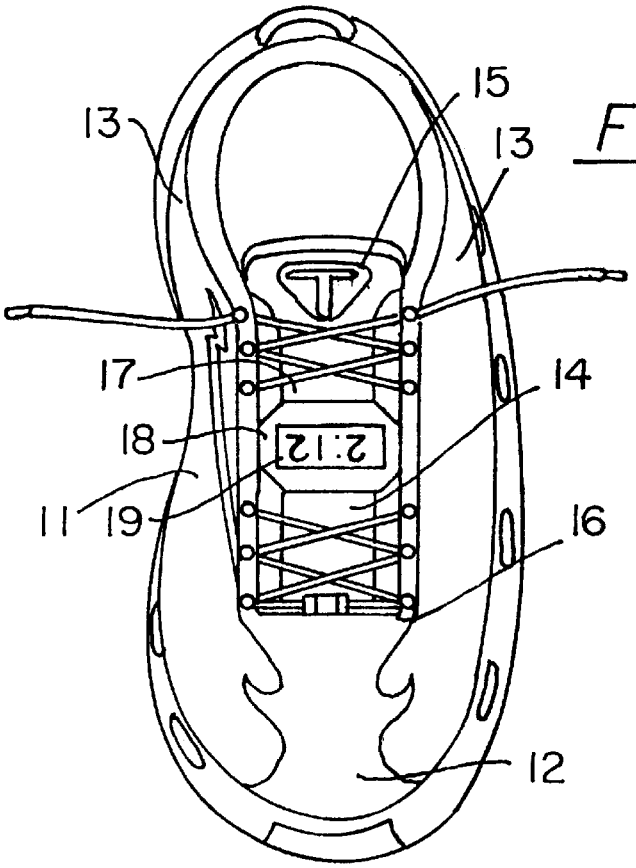
FIG. 2 is a top plan view of the present invention.
Figure 3:
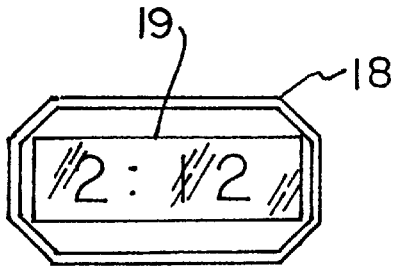
FIG. 3 is a detailed top plan view of the watch of the present invention.

With reference now to the drawings, and in particular to FIGS. 1 through 3 thereof, a new watch-containing shoe embodying the principles and concepts of the present invention and generally designated by the reference numeral 10 will be described.

As best illustrated in FIGS. 1 through 3, the watch-containing shoe 10 generally comprises a shoe 11 having a top portion 12 and side portions 13 and including a tongue member 14 having a top 17, a first end 15 and a second end 16 which is securely and conventionally attached and sewn to the top portion 12 of the shoe 11.

A watch 18 is securely and conventionally attached to the shoe 11. The watch 18 is securely disposed in the top 17 of the tongue member 14 intermediate of the first and second ends 15,16 thereof. The watch 18 includes a digital readout screen 19 with the watch 18 being disposed upside down relative to a toe portion of the shoe 11 as viewed from a front of the shoe 11 so that a user can be able to read the time on the digital readout screen 19 while wearing the shoe and while looking down upon the watch 18. The watch 18 is securely and conventionally attached upon an instep portion of the shoe 11.

In use, the user slips on the shoe 11 with the watch 18 being visible to the user upon the tongue 14 so that the user can be able to read the time displayed on the digital readout screen 19 of the watch 18 while standing and walking upon the shoe 11.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A watch-containing shoe comprising:

a shoe having a top portion and side portions and including a tongue member having a top, a first end and a second end which is securely attached to said top portion and extends between said side portions;

a connecting means for selectively connecting said side portions together, said connecting means extending over portions of said tongue member and defining a gap over said tongue member;

a watch being mounted on said top of said tongue between said first and second ends of said tongue;

wherein said watch is positioned on said tongue in alignment with said gap in said connecting means such that said watch is viewable through said gap without obstruction from said connecting means;

wherein said connecting means has a first portion and a second portion, said portions being spaced apart from each other in a longitudinal direction with respect to said tongue to define said gap;

wherein said watch includes a digital readout screen with said watch being disposed upside down relative to a toe portion of said shoe as viewed from a front of said shoe so that a user can be able to read the time on said digital readout screen while wearing said shoe and while looking down upon said watch;

said connecting means comprising laces and a plurality of eyelets formed in said side portions, a first set of eyelets being segregated towards said first end of said tongue and a second set of eyelets being segregated towards said second end of said tongue such that positioning said laces in said eyelets creates a space between portions of said laces in said first set of eyelets and portions of said laces in said second set of eyelets, spacing between said first set of eyelets and said second set of eyelets being greater than spacing between adjacent eyelets in each of said sets of eyelets; and wherein said watch is positioned at a midpoint between said first and second ends of said tongue.

* * * * *